United States Patent [19]

Freytag et al.

[11] Patent Number: 4,562,943

[45] Date of Patent: Jan. 7, 1986

[54] METHOD OF AND DEVICE FOR CONTROLLING THE POURING OF A MELT

[75] Inventors: Friedrich-Carl Freytag, Munich; Josef Gediga, Bruchköbel; Rolf Ruthardt, Hanau am Main; Wolfgang Wagner, Neuberg, all of Fed. Rep. of Germany

[73] Assignee: Leybold-Heraeus GmbH, Cologne, Fed. Rep. of Germany

[21] Appl. No.: 511,861

[22] Filed: Jul. 8, 1983

[30] Foreign Application Priority Data

Aug. 23, 1982 [DE] Fed. Rep. of Germany ..... 3231316

[51] Int. Cl.[4] ..... B22D 37/00; B22D 45/00

[52] U.S. Cl. ..... 222/590; 164/68.1; 164/133; 164/337; 164/493; 164/513; 222/592; 373/142

[58] Field of Search ..... 164/133, 80, 337, 471, 164/513, 483, 493, 68.1, 507; 222/597, 592, 590; 373/151, 152, 37, 142, 158

[56] References Cited

U.S. PATENT DOCUMENTS

| | | | |
|---|---|---|---|
| 2,871,533 | 2/1959 | Swainson | 164/133 X |
| 3,435,878 | 4/1969 | Howard et al. | 164/133 X |
| 3,484,026 | 12/1969 | Zehnder | 222/592 X |
| 3,484,840 | 12/1969 | Spoth et al. | 373/142 |
| 3,598,168 | 8/1971 | Clark | 164/133 X |
| 3,682,458 | 8/1972 | Piwonka et al. | 164/133 X |
| 3,777,040 | 12/1973 | Gell et al. | 373/37 |

FOREIGN PATENT DOCUMENTS

| | | | |
|---|---|---|---|
| 50-10689 | 4/1975 | Japan | 164/337 |

*Primary Examiner*—Nicholas P. Godici
*Assistant Examiner*—J. Reed Batten, Jr.
*Attorney, Agent, or Firm*—Max Fogiel

[57] ABSTRACT

An arrangement for controlling the pouring of a melt out of a crucible with a hole in the bottom which hole is blocked while the material is being melted with a closure plate that melts through locally as the result of heat transferred from the melt. To precisely establish the time at which the closure plate melts through, the plate is cooled from below while the starting material is being melted. Cooling is at least decreased and preferably terminated when it is time to pour out the melt. The plate can be cooled by a flow of a gas coolant directed against it or by contact with a cooling element that is raised into position against it from below.

7 Claims, 2 Drawing Figures

METHOD OF AND DEVICE FOR CONTROLLING THE POURING OF A MELT

Figure 1:
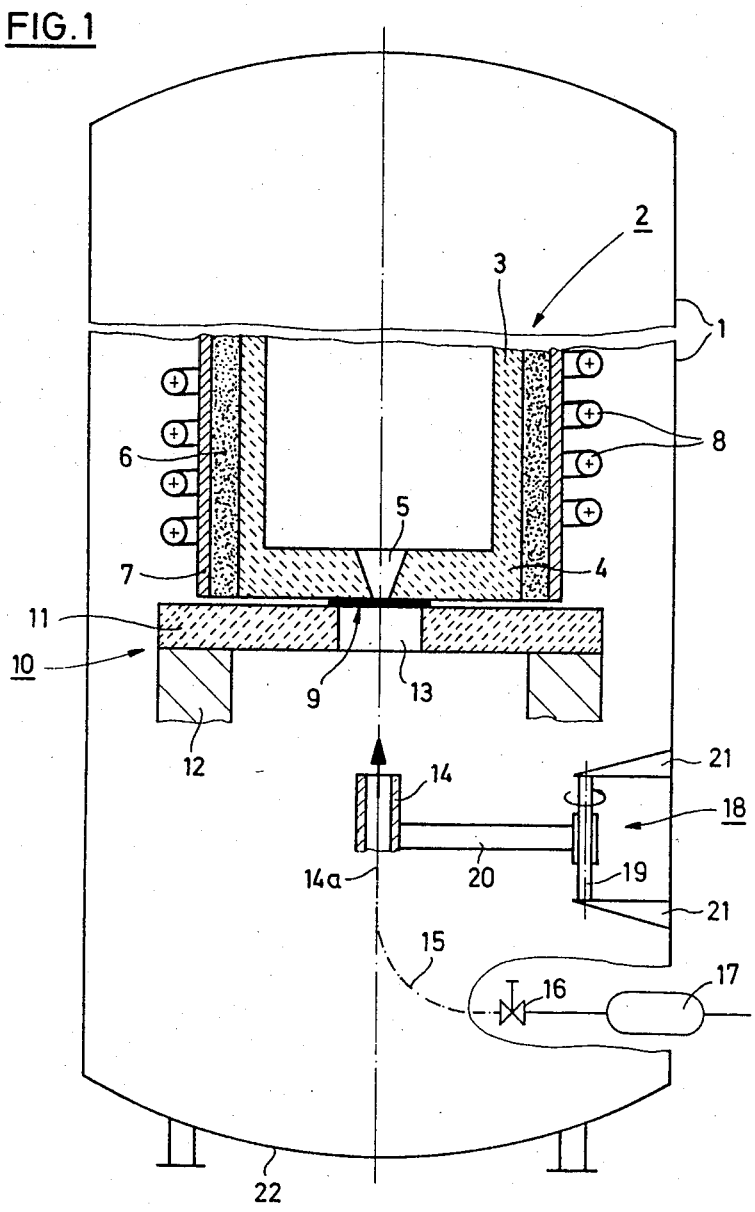

The invention concerns a method of controlling the pouring of the melt that results from melting a solid starting material out of a crucible with a hole in the bottom that, while the material is being melted, is blocked with a meltable closure plate that is preferably made out of a material compatible with the melt and that melts through locally as the result of heat transferred from the melt.

A method of this type is known from German Offenlegungsschrift No. 2 016 889. The time taken by the closure plate to melt through is controlled by its thickness. In particular, the plate has a thinner section in the middle. This method of control, however, is extremely imprecise.

First, the closure plate should be composed of the same material as the melt because it will necessarily mix with that of the melt as it melts through. If the material were of a different type it would contaminate the melt. If, however, it is of the same type it will have the same melting point as the starting material. If the melt is to attain a temperature above the melting point prior to pouring, this can only occur as the result of rapid and locally limited melting of the starting material and as the result of a temperature gradient toward the closure plate, which is initially cold. In other words, the thermal inertia of the plate is exploited to delay its melting. Such a process, however, is not sufficiently reproducible in practice.

The transfer of heat from the melt to the closure plate depends for example on the temperature distribution within the melt or on any internal mixing processes. The local temperature distribution of the melt depends in turn on the heat transfer of the heater that is necessarily present and that is usually an induction coil that surrounds the crucible to more or less of its height. The result, and also the result of the differing volumes of melt, can be a variable and difficult to control inductive coupling of the closure plate to the extent that the time it takes to melt through can no longer be controlled. Add to this that various thermal effects on the closure plate depend on whether the device is started up cold or is in continuous operation.

The present invention is intended as a method of the aforesaid type in which the pouring-out time can be established within narrow limits and in particular be selected as desired.

This objective is achieved in accordance with the invention in that the closure plate is cooled from below while the starting material is being melted and in that cooling is at least decreased and preferably terminated to initiate pouring.

The method in accordance with the invention preceptibly reduces the thermal effects of the melt on the closure plate by generating a wider temperature gradient between the bottom of the closure plate, which is the last region to melt through, and the melt than would exist without cooling. This makes it possible to retain the melt longer in the crucible and even to superheat it without running the risk of the closure plate breaking through prematurely. It is accordingly also possible to mix the melt more thoroughly when alloying it and to obtain samples for analyses more quickly. Cooling the closure plate also makes it possible to reduce the thermal effect of inductive coupling to the induction coil and to extensively compensate for the effect of even an extremely hot crucible or other parts of the device. Decreasing or completely terminating the cooling rapidly increases the thermal effect of the melt on the plate, which will then melt through extremely rapidly and initiate the pouring stage.

The plate can be cooled by a flow of an (inert or noble) gas coolant directed against it or by contact with a cooling element that is raised into position against it from below. The first method is preferred for melting and pouring processes carried out in a protective atmosphere, while the second can be carried out even in a vacuum.

The method in accordance with the invention is especially practical for the manufacture of metal powder by vaporizing a stream of molten metal with a gaseous medium. The opening in the bottom of the crucible can be kept closed for a pre-determined time and the melt overheated in it for a desired period of time and at a desired temperature.

Cooling the closure plate with a flow of gas has an additional advantage in this context. The plate must as a rule be raised into position against the bottom opening from below. This is usually done with a support that holds the plate and has an opening below and concentric with it. Thus, the plate is supported on only a thin border area of the support. If, then, a powerful current of gas coolant is directed against the plate, the gas will escape to the side and considerably cool the support, which can be made of sillimanite, as well. This will also decrease the overall temperature level of the affected parts of the device.

The thickness and material properties of the support will also, in conjunction with the force and temperature of the stream of gas, provide another means of establishing pouring time. Temperature differences of even 50° to 200° C. in the vicinity of the opening in the bottom of the crucible are absolutely decisive for opening or closing or unblocking the opening.

The invention also concerns a device for carrying out the aforesaid method and including a crucible with an opening in the bottom.

To attain essentially the same objective a further development of the invention has a nozzle below the opening in the bottom of the crucible having an axis aligned with the opening.

It is especially preferred for the nozzle to be fastened to a movable mount so that it can be pivoted out of the way of the melt when the latter is being poured out.

In one embodiment of the invention a movable cooling element is mounted below the opening in the bottom of the crucible and can be raised into position against the closure plate. It is practical for such a cooling element to be made out of a metal (like copper) that has satisfactory heat-conduction properties and for it to be capable of being connected by means of supply and removal lines to a coolant-circulating system.

Figure 2:
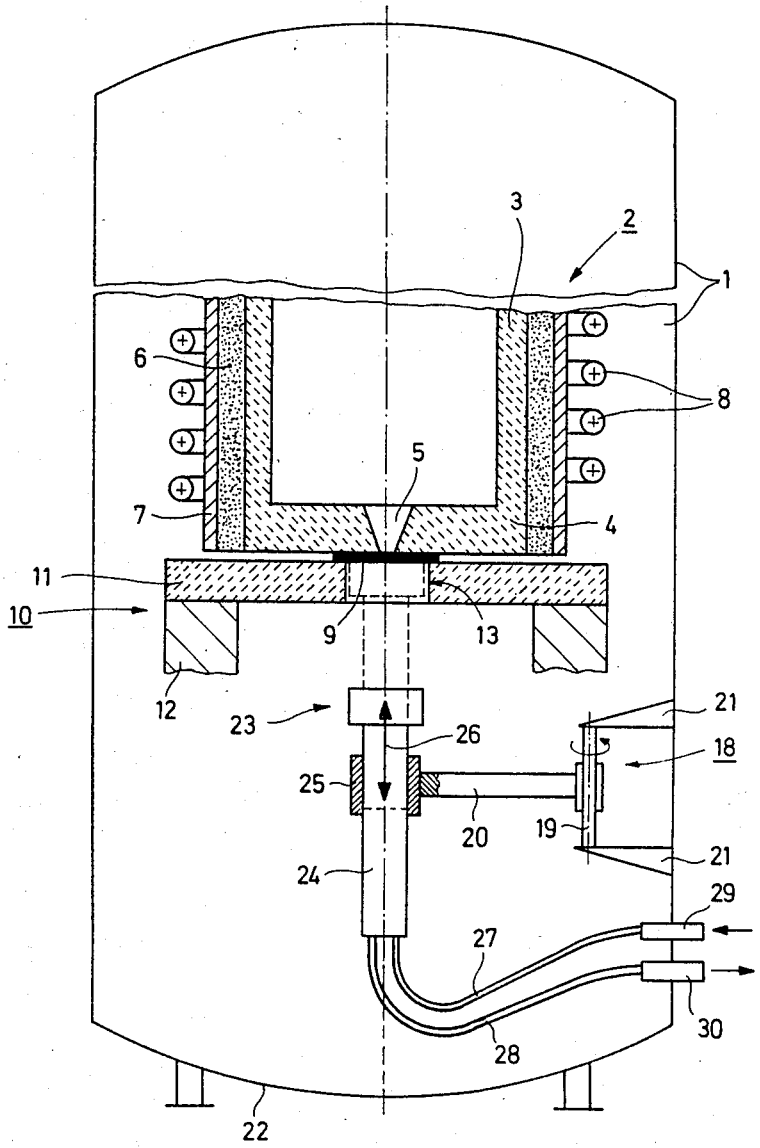

Some embodiments of the invention will now be specified by way of example with reference to the drawings, in which FIG. 1 is a vertical section through a melting and pouring device with a nozzle for a gas coolant and FIG. 2 is a vertical section similar to that in FIG. 1 but with a cooling element instead of a nozzle.

FIG. 1 shows a gas-tight container 1 in which a protective atmosphere (vacuum or protective gas) can be maintained. A melting device 2, consisting of a crucible 3 of ceramic material with an opening 5 in its bottom 4, is suspended within the container. The cylindrical section of crucible 3 is surrounded by heat insulation 6 and an outer jacket 7 of a design and material that prevent inductive coupling. There is an induction coil 8 outside jacket 7. Cooling water flows through coil 8.

Below and concentric with bottom opening 5 is a closure plate 9 made out of the same material that is to be melted (not illustrated). Closure plate 9 rests on a support 10 that consists of a ceramic plate 11 and a lifting device 12 that can raise closure plate 9 into position against the bottom 4 of crucible 3.

There is a cylindrical opening 13, coaxial with bottom opening 5 and closure plate 9 and forming an annular bearing for closure plate 9, in support 10 or, more specifically, in its ceramic plate 11.

Below cylindrical opening 13 there is a nozzle 14 with an axis **14*a* that is aligned with bottom opening 5 and closure plate 9 or its axis. Nozzle 14 communicates through a flexible line 15 and a valve 16 with a gas-coolant container 17 that contains argon. The gas coolant can be reprocessed in a recycling plant, which is not illustrated, and returned to coolant container 17**.

Nozzle 14 is attached to a movable mount 18 with a vertical rotating shaft 19 on which an extension arm 20 is mounted and with which it pivots. Rotating shaft 19 is mounted on the wall of container 1 with two booms 21.

The nozzle 14 in the position illustrated and charged with enough coolant, it directs a powerful jet of gas against closure plate 9 and against the inside surface of the cylindrical opening 13 in ceramic plate 11, generating the aforesaid cooling effects. When the flow of coolant is interrupted at valve 16 (and nozzle 14 pivoted to one side), the thermal equilibrium in closure plate 9 shifts towards higher temperatures that, after a predetermined period of time, cause closure plate 9 to melt through. The melt will flow out through bottom opening 5 and can for example be broken up by a vaporizing device, which is not illustrated, and fall in the form of extremely fine particles of metal to the floor 22 of container 1.

The parts in FIG. 2 that are equivalent to those in FIG. 1 are labeled with the same reference numbers. At the free end of the extension arm 20 in this embodiment is, instead of a nozzle (as in FIG. 1), a cooling element 23 in the shape of a flattened cylinder that can be introduced precisely, with regard to permissible tolerances of course, into cylindrical opening 13 as indicated by the broken lines. For this purpose cooling element 23 has a cylindrical shaft 24 that is mounted in a guide 25 in such a way that it can be raised and lowered by a drive mechanism that is not illustrated in the direction indicated by double-headed arrow 26.

Cooling element 23 communicates with coolant-circulating system, not illustrated, through a coolant-supply line 27 and a coolant-extraction line 28. The container 1 in this embodiment is vacuumized and has two vacuum seals 29 and 30 for coolant lines 27 and 28.

While the starting material, which is not illustrated, is being melted and while it may be being subjected to other treatments, cooling element is maintained in the position represented by the broken lines, where it is held against the bottom surface of closure plate 9. This will maintain the lower surface of the plate at a temperature in the vicinity of that of the cooling element and much closer to that of the cooling element that to that in crucible 3. It is accordingly impossible for closure plate 9 to melt locally as long as the cooling element is maintained in this position with coolant flowing through it. If the melt should indeed ever break through the plate it would immediately harden against the cooling element and plug up the leak. The system can in fact be regarded in the extreme case as a sort of "freeze valve."

To initiate the pouring process it is necessary only to lower cooling element 23 into the position represented by the continuous lines and pivot it to one side so that, for example, powder production can begin with the vaporization of the molten metal flowing out of bottom opening 5.

We claim:

1. Method of controlling the pouring of a melt resulting from melting a solid starting material out of a crucible with an opening in the crucible bottom, comprising the steps of: blocking the opening while the material is being melted with a meltable closure plate made of material compatible with the melt, said closure plate melting through locally due to heat transferred from the melt, cooling said closure plate from below while the starting material is being melted and before said closure plate is melted through by directing a flow of gas against said closure plate at an underside of said plate, and at least reducing said cooling to initiate pouring of melted material through said opening.

2. Method of controlling the pouring of a melt resulting from melting a solid starting material out of a crucible with an opening in the crucible bottom, comprising the steps of: blocking the opening while the material is being melted with a meltable closure plate made of material compatible with the melt, said closure plate melting through locally due to heat transferred from the melt, cooling said closure plate from below while the starting material is being melted before said closure plate is melted through by holding a cooling element in contact with an underside of said plate, said cooling element being movable relative to said closure plate, said cooling element being raised into position against said plate from below, and removing said cooling element from contact with said plate to initiate pouring of melted material through said opening.

3. Apparatus for controlling the pouring of a melt resulting from melting a solid starting material out of a crucible with an opening in the crucible bottom, comprising: a meltable closure plate covering said opening and made of material compatible with the melt, said plate being melted through locally due to heat transferred from the melt, said closure plate being cooled from below while the starting material is being melted and before said closure plate is melted through, a nozzle below the opening in the bottom of the crucible and having an axis aligned with said opening for directing a flow of gas against said closure plate at an underside of said plate for preventing said closure plate from melting through, and means for at least reducing said cooling to initiate pouring of melted material through said opening.

4. Apparatus as defined in claim 3, wherein said nozzle is fastened to a movable mount.

5. Apparatus as defined in claim 3, including support means with a ceramic plate carrying said closure plate, said ceramic plate having an opening coaxial with said opening in said crucible bottom, lifting means for raising said closure plate against said opening in said crucible bottom, pivotal mounting means for mounting said nozzle, said nozzle being pivotable on said mounting means to be pivotable toward and away from said opening in said ceramic plate, a source of gas flow connected to said nozzle, and regulating means between said source and said nozzle for regulating the flow of gas emitted by said nozzle and incident on the underside of said closure plate.

6. Apparatus for controlling the pouring of a melt resulting from melting a solid starting material out of a crucible with an opening in the crucible bottom, comprising: a meltable closure plate covering said opening and made of material compatible with the melt, said plate being melted through locally due to heat transferred from the melt, said closure plate being cooled from below while the starting material is being melted before said closure plate is melted through, a movable cooling element mounted below said opening in the bottom of said crucible and raisable into position against said closure plate for preventing said closure plate from melting through, said cooling element being held in contact with an underside of said plate for cooling said plate to prevent melting through of said plate, said cooling element being removed from contact with said plate to initiate pouring of melted material through said opening.

7. Apparatus as defined in claim 6, including support means having a ceramic plate, said closure plate resting on said ceramic plate, said ceramic plate having an opening coaxial with said opening in said crucible bottom, and lifting means for raising said ceramic plate and thereby said closure plate into a position against said opening of the bottom of said crucible.

* * * * *